US005899173A

United States Patent [19]

Okabe et al.

[11] Patent Number: 5,899,173

[45] Date of Patent: May 4, 1999

[54] VISCOUS FLUID HEATER

[75] Inventors: Takanori Okabe; Takashi Ban, both of Kariya, Japan

[73] Assignee: Kabushiki Kaisha Toyoda Jidoshokki Seisakusho, Kariya, Japan

[21] Appl. No.: 08/903,292

[22] Filed: Jul. 30, 1997

[30] Foreign Application Priority Data

Aug. 5, 1996 [JP] Japan ..... 8-205810

[51] Int. Cl.[6] ..... F22B 3/06

[52] U.S. Cl. ..... 122/26; 126/247

[58] Field of Search ..... 122/26; 126/247; 237/1 R, 12.3 R

[56] References Cited

U.S. PATENT DOCUMENTS

| | | | |
|---|---|---|---|
| 4,277,020 | 7/1981 | Grenier | 237/1 R |
| 4,454,861 | 6/1984 | Grenier | 126/247 |
| 4,501,231 | 2/1985 | Perkins | 126/247 |
| 4,773,388 | 9/1988 | Herbulot et al. | 126/247 |
| 5,392,737 | 2/1995 | Newman, Sr. et al. | 126/247 |
| 5,577,467 | 11/1996 | Bormann | 126/247 |
| 5,704,320 | 1/1998 | Ban et al. | 122/26 |

FOREIGN PATENT DOCUMENTS

| | | |
|---|---|---|
| 411716 | 1/1992 | Japan . |
| 2003265 | 3/1979 | United Kingdom . |

*Primary Examiner*—Teresa Walberg
*Assistant Examiner*—Jiping Lu
*Attorney, Agent, or Firm*—Morgan & Finnegan, L.L.P.

[57] ABSTRACT

A viscous fluid heater has a heating chamber and a radiator chamber defined in a housing and transfers heat generated by shearing viscous fluid in the heating chamber with a rotor to circulating fluid in the radiator chamber. The housing includes outer and inner housing parts, which are secured to each other. An inner wall surface is formed on the outer housing part, and an outer wall is formed on the inner housing part. The radiator chamber is defined between the inner wall and the outer wall to conduct the circulating fluid through the radiator chamber.

9 Claims, 4 Drawing Sheets

VISCOUS FLUID HEATER

BACKGROUND OF THE INVENTION

The present invention relates to viscous fluid heaters that have a rotor, a heating chamber and a radiator chamber. More particularly, the present invention relates to a viscous fluid heater that has a multi-part housing.

Much attention has recently been focused on engine-driven viscous fluid heaters as auxiliary heat sources for vehicles. Japanese Unexamined Utility Model Publication No. 4-11716 discloses a viscous fluid heater that has a heating chamber and a cylindrical radiator chamber. The radiator chamber is defined about the heating chamber and constitutes a part of a coolant circulation passage. The housing of the heater consists of two parts combined with each other. More specifically the housing consists of a casing having an opening and a cover that closes the opening of the casing. The casing has a double cylinder structure including a cylindrical inner wall and a cylindrical outer wall with one end closed by a bottom wall. The inner wall defines the heating chamber therein and the outer wall is formed about the inner wall. A plurality of radiator fins protrude from the outer surface of the inner wall into the radiator chamber. The radiator chamber is provided with an inlet port, through which circulating water enters the chamber, and an outlet port, through which the water is discharged to an external heating circuit.

A drive shaft is rotatably supported in the casing by a bearing. The drive shaft has a plurality of disk-shaped inner plates, which are secured to the drive shaft and accommodated in the heating chamber. The inner plates constitute a rotor, which integrally rotates with the drive shaft. A plurality of annular outer plates are formed on the inner surface of the inner wall of the casing. Each outer plate faces, or is aligned with, one of the inner plates of the rotor at a predetermined distance from the corresponding inner plate. Rotation of the drive shaft rotates the inner plates, or the rotor, relative to the outer plates in the casing inner wall. This causes the rotor to shear the viscous fluid and produces friction between the viscous fluid and the inner and outer plates. The viscous fluid is heated accordingly. Heat exchange takes place between the heated viscous fluid and the circulating water in the radiator chamber. This heats the circulating water and warms the passenger compartment as the water flows into the heating circuit.

In the above described prior art heater, the radiator chamber is defined about the heating chamber. If the heating chamber and the radiator chamber are relatively long in the axial direction, a guiding member must be provided in the radiator chamber for guiding the flow of circulating water along a desired course. However, forming the guiding member in the radiator chamber is difficult because the radiator chamber has a relatively narrow annular clearance between the inner wall and the outer wall of the casing and the inner wall and the outer wall are formed only on the casing. Further, forming fins in the radiation chamber for improving the heat exchange efficiency of the radiator chamber is difficult. Without the guiding member and the fins, circulating water entering the radiator chamber through the inlet port is not evenly distributed in the radiator chamber but directly flows from the inlet port to the outlet port and is discharged from the outlet port. This degrades the heat exchange efficiency of the radiator chamber.

SUMMARY OF THE INVENTION

Accordingly, it is an objective of the present invention to provide a viscous fluid heater that reduces the number of parts comprising the housing, and has a structure that facilitates forming of a guiding member between the inner wall and the outer wall which define a radiator chamber about the heating chamber, for guiding the circulating fluid.

To achieve the foregoing objective in accordance with the present invention, a viscous fluid heater having a heating chamber and a radiator chamber defined in a housing is provided. The heater transfers heat, generated by shearing viscous fluid in the heating chamber with a rotor, to circulating fluid in the radiator chamber. The housing includes first and second housing segments, which are combined with and are secured to each other. An inner wall is integrally formed with one of the first housing segment and the second housing segment. An outer wall is integrally formed with the other of the first and second housing segments. The radiator chamber is defined between the inner wall and the outer wall to permit the circulating fluid to flow through the radiator chamber.

Other aspects and advantages of the invention will become apparent from the following description, taken in conjunction with the accompanying drawings, illustrating by way of example the principals of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of a viscous fluid heater according to the present invention that is incorporated in a heating apparatus of a vehicle will now be described with reference to FIGS. 1 and 2.

Figure 1:
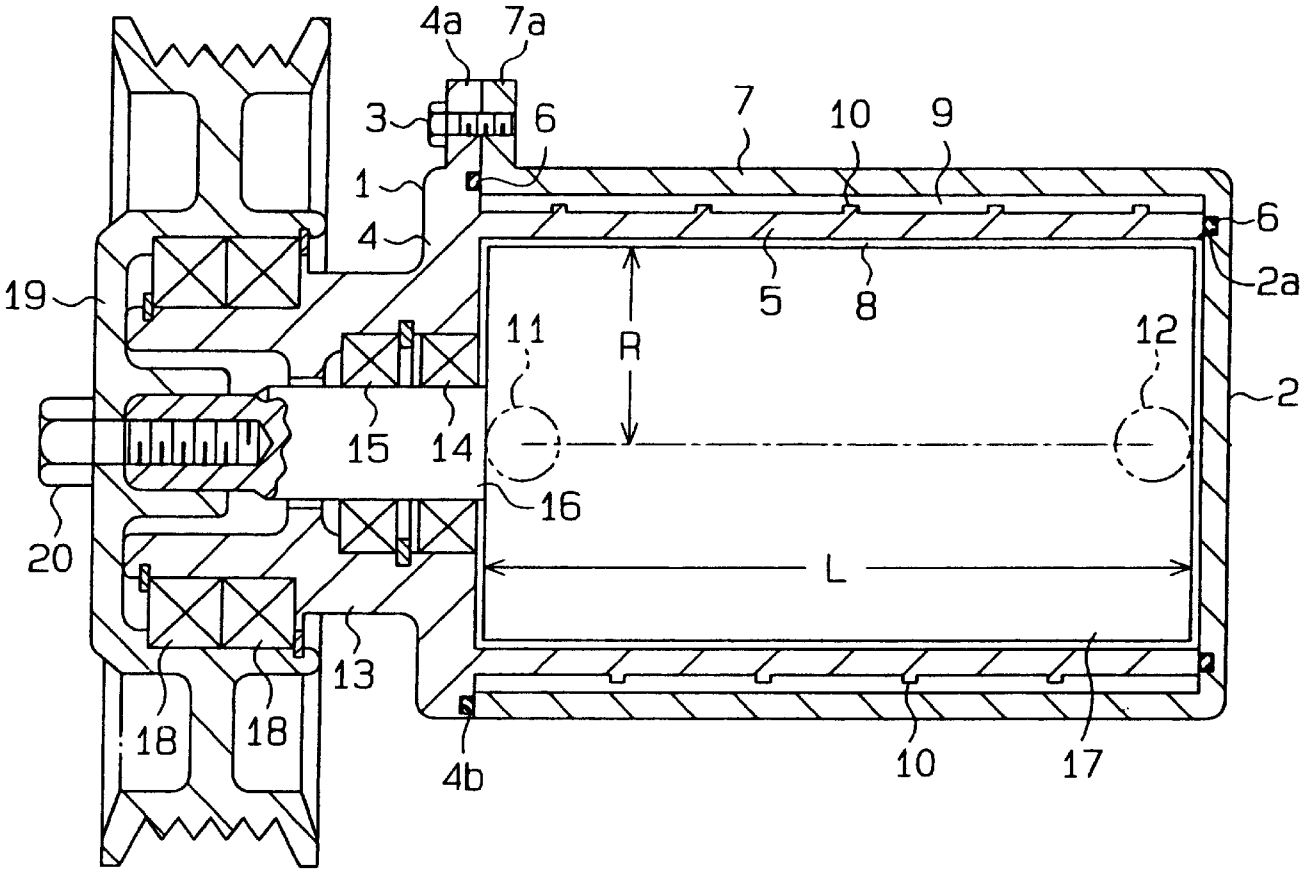
FIG. 1 is a cross-sectional view illustrating a viscous fluid heater according to a first embodiment.

FIG. 1 shows a viscous fluid heater according to a first embodiment. The housing of the heater is constituted by a front housing 1 and a rear housing 2. The housings 1, 2 are combined with and fastened to each other by a plurality of bolts 3 (only one shown). The front housing 1 includes a base plate 4 forming a substantially closed end of the housing, and a cylindrical inner wall 5 integrally formed with the plate 4. A plurality of projections 4*a* are integrally formed with and protrude radially from the periphery of the plate 4. Each projection 4*a* has a hole through which one of the bolts 3 is inserted. An annular groove 4*b* is formed on a surface of the plate 4 against which the rear housing 2 abuts. A seal 6, for example an O ring, is fitted in the groove 4*b*. The rear housing 2 is formed as a cylinder having an integrally formed closed end, and the diameter of the housing 2 is equal to the diameter of the base plate 4 of the front housing 1. The cylindrical portion of the housing 2 constitutes an outer wall 7. A plurality of projections 7*a* protrude radially from and are formed integrally with the periphery of the outer wall 7 at its open end. Each projection 7*a* has a threaded hole into which one of the bolts 3 is screwed. An annular groove 2*a* is formed in the bottom of the housing 2 in a surface against which the inner wall 5 abuts. A seal 6 is fitted in the groove 2*a*.

The housings 1, 2 are fastened to each other by the bolts 3 with each of the inner wall 5 and the outer wall 7 contacting the corresponding seal 6. A heating chamber 8 is defined by the rear end face of the plate 4, the inner surface of the inner wall 5 and the front end face of the rear housing 2. A water jacket 9, or a radiator chamber, is defined between the inner wall 5 and the outer wall 7. A helical fin 10 is integrally formed with, and projects from the outer surface of the inner wall 5 such that the peripheral surface of the fin 10 is located at about midway between the outer surface of the inner wall 5 and the inner surface of the outer wall 7.

Figure 2:
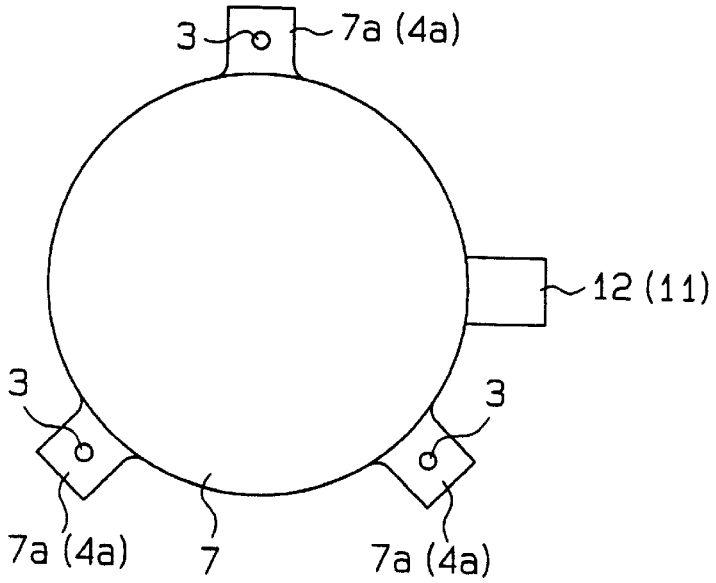
FIG. 2 is a schematic diagram of the heater of FIG. 1 as viewed from right side of FIG. 1.

As shown in FIGS. 1, and 2 an inlet port 11 is formed on the front end of the outer wall 7, and an outlet port 12 is formed on the rear end of the outer wall 7. The ports 11, 12 communicate with the water jacket 9. The inlet port 11 receives circulating water from a heating circuit (not shown) provided in the vehicle, while the outlet port 12 returns circulating water in the water jacket 9 to the circuit.

A cylindrical supporter 13 is formed integrally with and protruding forward from the center portion of the base plate 4. A drive shaft 16 is rotatably supported by the supporter 13 with a shaft seal 14 and a bearing 15 in between in an opening through the otherwise closed end of the housing. A rotor 17 is press fitted onto the drive shaft 16 and is accommodated in the heating chamber 8. The rotor 17 is thus also supported by the supporter 13. The shaft seal 14 is constituted mainly by an oil seal. The rotor 17 is a hollow cylinder made of aluminum alloy. The length L of the rotor 17 is longer than the radius R of the rotor 17.

A pulley 19 is secured to the front end (left end as viewed in FIG. 1) of the drive shaft 16 by a bolt 20. The pulley 19 rotates with respect to and supported by the supporter 13 with a bearing 18 located in between. A belt (not shown) is engaged with the periphery of the pulley 19. The belt operably couples the pulley 19 with a vehicle engine, which functions as an external drive source.

The heating chamber 8 is filled with silicone oil, which functions as viscous fluid. In other words, the silicone oil fills the space between the inner surface of the heating chamber 8 and the outer surface of the rotor 17. Part of the space is however filled with gas (for example, air) for absorbing expansion of the silicone oil when the temperature increases.

When the engine is running, the drive force of the engine is transmitted to the pulley 19 with the belt thereby rotating the pulley 19. The drive shaft 16 and the rotor 17 are integrally rotated with the pulley 19. Accordingly, the silicone oil is sheared between the inner surface of the heating chamber 8 and the outer surface of the rotor 17. This heats the silicone oil. Heat exchange takes place between the heated silicone oil and the circulating water as circulating fluid in the water jacket 9. The heated water warms the passenger compartment as it flows through the heating circuit (not shown). The circulating water is drawn into a first end of the water jacket 9 by the inlet port 11. The water is then helically moved along the outer surface of the inner wall 5 in the water jacket 9 and is discharged to the heating circuit through the outlet port 12 located at a second end. The fin 10 projecting from the inner wall 5 in the water jacket 9 efficiently transmits the heat of the heating chamber 8 to the circulating water in the water jacket 9.

The above described preferred embodiment has the following advantageous effects.

The water jacket (radiator chamber) 9 is defined about the heating chamber 8 by combining the front housing 1, which has the inner wall 5, with the rear housing 2, which has the outer wall 7. This reduces the number of the parts constituting the housing thereby facilitating the assembly of the housing.

The water jacket 9 is provided only about the periphery of the rotor 17. This simplifies the construction of the housing compared to the construction of a housing in which the water jacket 9 extends to the end surface of the rotor 17. Also, the speed of the rotor 17 is greatest at its circumferential periphery. Thus, providing the water jacket 9 about the periphery of the rotor 17 efficiently transfers the majority of the heat generated.

The fin 10 is integrally formed with the inner wall 5, which defines the water jacket 9 and the heating chamber 8, and the fin 10 projects into the water jacket 9. This further improves the heat exchange efficiency in the water jacket 9. The fin 10 is formed on the inner wall 5 before the outer wall 7 covers the inner wall 5. Forming the fin 10 is thus easier than the prior art in which the inner wall and the outer wall are integrally formed.

The fin 10, which is helically formed on the outer surface of the inner wall 5, functions as a guide for guiding the flow of the circulating water in the water jacket 9. The water introduced in the water jacket 9 through the inlet port 11 therefore does not directly flow to the outlet port 12, but is evenly distributed in the water jacket 9 before being discharged to the external heating circuit through the outlet port 12. This further improves the heat exchange efficiency in the water jacket 9. Guiding the flow of the circulating water in the heater reduces resistance to flow in the passage of the heating circuit. Reduced resistance prevents the circulating water, which functions as heat transfer medium, from staying at one location in the circuit. This improves the overall efficiency including the heat exchange efficiency between the silicone oil in the heating chamber 8 and the heat exchange efficiency between the circulating water and the air in the vehicle passenger compartment.

The rotor 17 has a cylindrical outer surface, the length L of which is longer than the radius R. This ensures a great amount of heat generation at the circumferential periphery of the rotor 17. The heating amount $Q_1$ of each end face of the rotor 17 is expressed by the following equation, in which characters $\mu$, $\sigma_1$, $\sigma_2$ and $\omega$ represent the coefficient of viscosity of the silicone oil, the distance between the outer surface of the rotor 17 and the inner surface of the heating chamber 8, the distance between each end face of the rotor 17 and the corresponding inner surface of the heating chamber 8, and the angular velocity of the rotor 17, respectively.

$$Q_1=\Pi\mu\omega^2R^4/\sigma_2$$

The heating amount $Q_2$ of the peripheral surface of the rotor 17 is expressed by the following equation.

$$Q_2=2\ \Pi\mu\omega^2R^3L/\sigma_1$$

In the heater of the preferred embodiment, shearing of the viscous fluid is performed chiefly by the circumferential periphery of the rotor 17. Therefore, $\pi_1$ is set smaller than $\sigma_2$ ($\sigma_1<\sigma_2$). Further, since the radius R is shorter than the length L (R<L), $Q_1$ is smaller than $Q_2$ ($Q_1<Q_2$). Consequently, the greatest heating amount $Q_2$ is ensured at the circumferential periphery of the rotor 17. Although the rotor 17 needs to be formed relatively long, the diameter of the rotor 17 may be relatively small. Thus, the heater can be accommodated in a space having relatively small height and width as long as it has a sufficient length.

Since the rotor 17 is supported in a cantilevered manner, the entire end face opposite to the end face supported by the drive shaft 16 functions as a shearing plane. This enlarges the effective area of heat generation thereby improving the heating efficiency of the heater.

The rotor 17 is a hollow body. This reduces the weight of the rotor 17 thereby reducing the weight of the entire heater. Further, the light rotor 17 allows the heater to consume less drive power. The fin 10 formed on the inner wall 5 does not contact the outer wall 7. The heat generated in the heating chamber 8 is thus not directly transmitted to the outer wall 7 via the fin 10. This prevents the heat from being dissipated to the outside of the heater.

Figure 3:
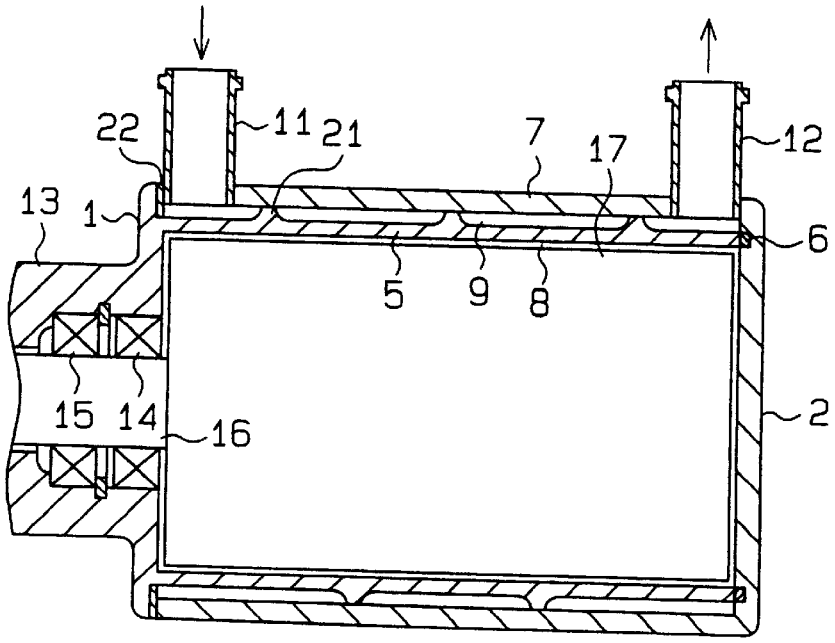
FIG. 3 is a cross-sectional view illustrating a heater according to a second embodiment.

A second embodiment of the present invention will now be described with reference to FIG. 3. The second embodiment is different from the first embodiment in that the water jacket 9 is formed helically. Otherwise, the second embodiment is substantially the same as the first embodiment. Thus, like or the same reference numerals are given to those components that are like or the same as the corresponding components of the first embodiment.

A helical guiding member 21 is integrally formed on the outer surface of the inner wall 5. The guiding member 21 contacts the inner surface of the outer wall 7 thereby helically defining the water jacket 9. That is, a helical water jacket 9 is formed between the inner wall 5 and the outer wall 7 about the heating chamber 8.

The inlet port 11 is formed at the front end of the periphery of the outer wall 7 and is communicated with a first end of the helical water jacket 9. The outlet port 12 is formed at the rear end of the periphery of the outer wall 7 and is communicated with a second end of the water jacket 9.

In this embodiment, a gasket 22 is placed between the front housing 1 and the outer wall 7 instead of a seal ring.

The second embodiment has the following advantageous effects.

The water jacket 9 has a helical shape and the inlet port 11 and the outlet port 12 are formed at the first end and the second end, respectively. The structure causes circulating fluid drawn in the water jacket 9 to pass through all parts of the water jacket 9 before being discharged to the external heating circuit. This improves the heat exchange efficiency in the water jacket 9.

The helical guiding member 21 projects from the outer surface of the inner wall 5 and contacts the inner surface of the outer wall 7. In other words, the guiding member 21 defines the space between the outer wall 5 and the inner wall 7 thereby forming a helical water jacket 9. Forming of the helical water jacket 9 is therefore simple.

Since the guiding member 21 is formed on the inner wall 5, the heat of the heating chamber 8 is transmitted to the circulating water in the water jacket 9 through the guiding member 21 as well as through the surfaces of the inner wall 5. This improves the heat exchange efficiency of the heater.

Although only two embodiments of the present invention have been described so far, it should be apparent to those skilled in the art that the present invention may be embodied in many other specific forms without departing from the spirit or scope of the invention. Particularly, it should be understood that the invention may be embodied in the following forms.

Figure 4:
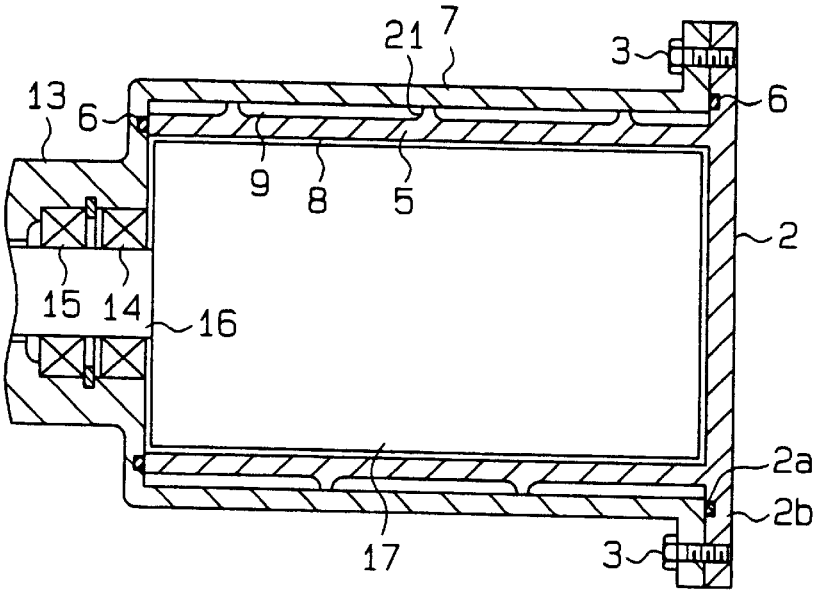
FIG. 4 is a cross-sectional view illustrating another embodiment.

As shown in FIG. 4, the inner wall 5 may be formed on and integrally with the rear housing 2 and the outer wall 7 may be formed on the front housing 1. In this case, a flange 2*b* having the same diameter as the outer wall 7 is formed on and integrally with the rear housing 2. The flange 2*b* has an annular groove 2*a*. A plurality of integrally formed projections protrude radially from the periphery of the flange 2*b*. A plurality of projections are also integrally formed on the rear end of the outer wall 7, each corresponding to one of the projections of the flange 2*b*. Each projection has a hole through which one of the bolts 3 is inserted for securing the housings 1, 2 to each other.

Figure 5:
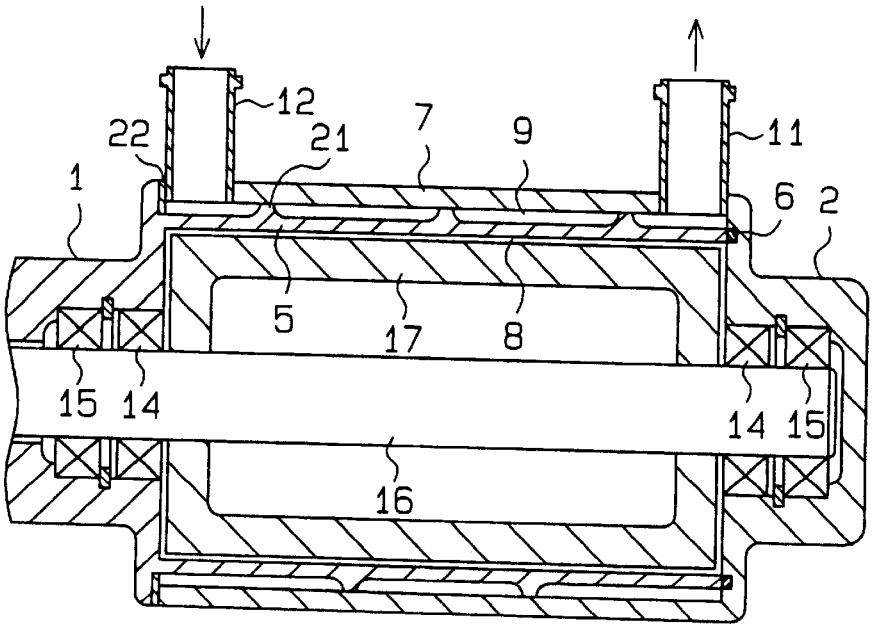
FIG. 5 is a cross-sectional view illustrating yet another embodiment.

As shown in FIG. 5, the drive shaft 16 may be supported at each end by a shaft seal 14 and a bearing 15. The guiding member 21 may be integrally formed on the inner surface of the outer wall 7. The guide 21 may be formed on the inner surface of the outer wall 7 as well as on the outer surface of the inner wall 5. Before combining the housings 1, 2, the outer wall 7 has a large space therein. Thus, forming the guiding member 21 on the inner surface of the outer wall 7 is easier than doing so in the prior art apparatus having integrally formed inner wall and outer wall.

The guide 21 may be spaced apart from the inner surface of the outer wall 7.

Figure 6:
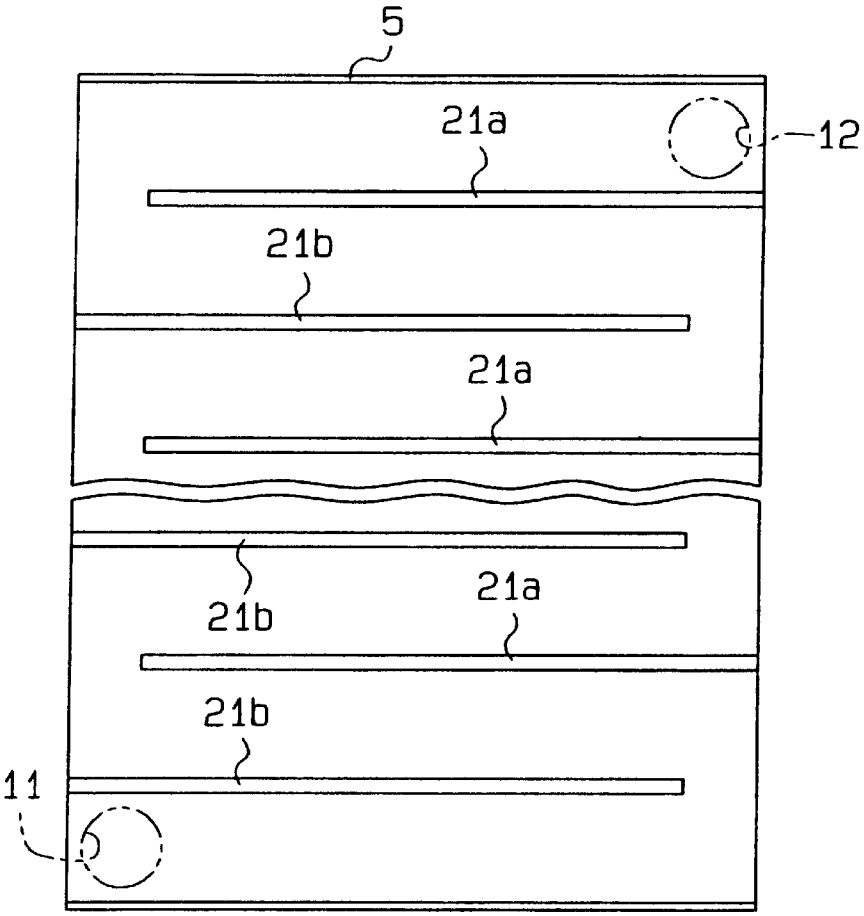
FIG. 6 is a development showing the outer surface of an inner wall according to another embodiment.

The guiding member 21 does not have to be a helically formed single projection but may be a plurality of helically formed projections or a plurality of projections extending along the axis of the rotor 17. For example, as shown in FIG. 6, linear guiding members 21*a* and 21*b* may be alternately formed on and integrally with the outer surface of the inner wall 5 with a predetermined interval between each adjacent pair of the guiding members. The guiding members 21*a* extend from the rear end of the water jacket 9 to the vicinity of the front end. The guiding members 21*b* extend from the front end of the water jacket 9 to the vicinity of the rear end. FIG. 6 is a development of the outer surface of the inner wall 5. The structure allows the circulating water drawn into the water jacket 9 through the inlet port 11 to pass through all parts the water jacket 9, which improves the heat exchange efficiency.

Both the guiding member 21 and the fin 10 may be provided in the heater. This improves the heat exchange efficiency in the water jacket 9.

The guiding member 21 and the fin 10 may be omitted.

The housings 1, 2 do not have to be secured to each other by screwing the bolts 3 in the threaded holes formed in the rear housing 2. Instead, the housings 1, 2 may be secured to each other by inserting the bolts 3 in unthreaded holes formed in the housings 1, 2 and screwing a nut to the end of each bolt 3.

Figure 7:
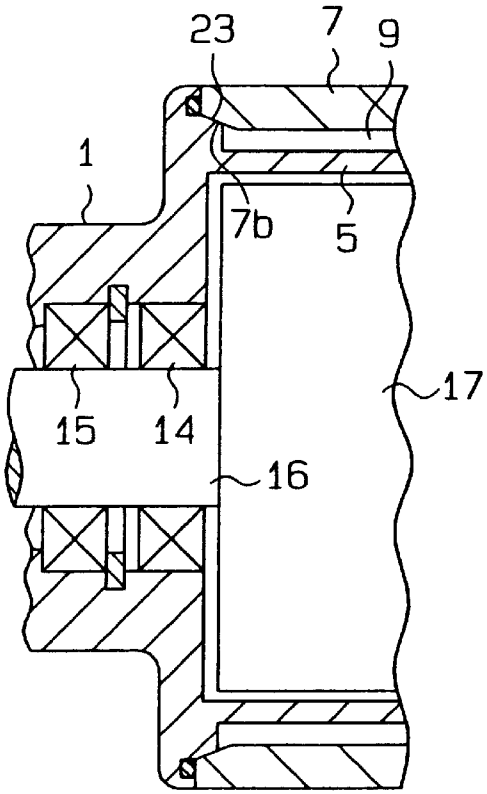
FIG. 7 is a partial cross-sectional view illustrating a heater of yet another embodiment.

As shown in FIG. 7, a conical surface 7*b* may be formed in the peripheral portion of the outer wall 7 such that the inner diameter of the outer wall 7 increases toward its end, and a conical surface 23, which is engaged with the conical surface 7*b*, may be formed on the front housing 1. This structure facilitates accurate alignment of the centers of the housings 1, 2.

An electromagnetic clutch may be provided between the pulley 19 and the drive shaft 16 for selectively transferring the drive force of the engine to the drive shaft 16 as necessary. The term "viscous fluid" in this specification refers to any type of medium that generates heat based on fluid friction when sheared by a rotor. The term is therefore not limited to highly viscous fluid or semi-fluid material, much less to silicone oil.

Although several embodiments of the present invention have been described herein, it should be apparent to those skilled in the art that the present invention may be embodied in many other specific forms without departing from the spirit or scope of the invention.

Therefore, the present examples and embodiments are to be considered as illustrative and not restrictive and the invention is not to be limited to the details given herein, but may be modified within the scope and equivalence of the appended claims.

What is claimed is:

1. A viscous fluid heater having a housing providing a cylindrical-shaped heating chamber and a surrounding cylindrical-shaped separate radiator chamber, a cylindrical rotor mounted for rotation within said heating chamber for shearing and thereby heating viscous fluid therein whereby heat is transferred to circulating fluid within the radiator chamber, said heater housing comprising a hollow cylindrical front housing comprising a cylindrical wall having an open end, and a front housing closed end opposite to said cylindrical wall open end, said front housing closed end being formed integrally with said front housing cylindrical wall, and a hollow cylindrical rear housing comprising a cylindrical wall having an open end, and a rear housing closed end opposite to said cylindrical wall open end, said rear housing closed end being formed integrally with said rear housing cylindrical wall, one of said front and rear housing cylindrical walls having larger diameter than, and being in concentrically surrounding spaced relation to the other of said front and rear housing cylindrical walls with the said open end of each housing cylindrical wall being in sealing engagement with the said closed end of the other housing, the respective of said front and rear housing closed ends being in opposed spaced relation to each other, whereby said heating chamber and said radiator chamber are defined between said front and rear housing closed ends.

2. A viscous fluid heater according to claim 1, wherein a generally circular sealing member is disposed between each of said front and rear housing cylindrical wall open ends and the closed end of the other of said front and rear housings with which the sealing member is in sealing engagement.

3. A viscous fluid heater according to claim 2, wherein at least one of said front and rear housing closed ends has a generally circular groove having one of said generally circular sealing members therein to receive said cylindrical wall open end of the other housing against the sealing member to provide the sealing engagement.

4. A viscous heater according to claim 3, wherein the closed end of said at least one of said housings includes a radially outward projecting, peripherally extending flange, said generally circular groove of the housing closed end being formed in said flange at a location spaced radially outward from said cylindrical wall of the housing.

5. A viscous fluid heater according to claim 1, wherein a conical surface is provided on said open end of each of said front and rear housing cylindrical walls, and a comating conical surface is provided on said closed end of each of said front and rear housings for receiving the respective of said cylindrical wall open end conical surfaces.

6. A viscous fluid heater according to claim 1, wherein a plurality of circumferentially spaced apart radially outward projections are integrally formed on the closed end of one of said front and rear housings, and a corresponding plurality of correspondingly spaced apart radially outward projections are integrally formed on the open end of the cylindrical wall of the other of said front and rear housings in respective cofacing relation to the first said plurality of projections, each of said respective cofacing projections being bolted together.

7. A viscous fluid heater according to claim 1, wherein said front and rear housing cylindrical walls have substantially the same lengths.

8. A viscous heater according to claim 1, which further comprises a rotatable drive shaft through, and supported by the closed end of one of said housings and extending into said heating chamber, said cylindrical rotor being mounted on said drive shaft for rotation therewith, said shaft and rotor being supported by said one housing in cantilevered manner within said heating chamber.

9. A viscous heater according to claim 1, which further comprises a rotatable drive shaft through the closed end of one of said housings and into the closed end of the other of said housings and supported by both housings, said cylindrical rotor being mounted on said drive shaft for rotation therewith within said heating chamber.

* * * * *